US009765514B2

(12) United States Patent
Guthrie

(10) Patent No.: US 9,765,514 B2
(45) **Date of Patent: *Sep. 19, 2017**

(54) ENERGY-EFFICIENT MOBILE BUILDINGS

(71) Applicant: James B. Guthrie, Rochester, IN (US)

(72) Inventor: James B. Guthrie, Rochester, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/860,994

(22) Filed: Sep. 22, 2015

(65) Prior Publication Data

US 2016/0076241 A1 Mar. 17, 2016

Related U.S. Application Data

(63) Continuation of application No. 14/144,714, filed on Dec. 31, 2013, now Pat. No. 9,140,064.

(60) Provisional application No. 61/748,560, filed on Jan. 3, 2013.

(51) Int. Cl.

| | |
|---|---|
| ***E04C 2/52*** | (2006.01) |
| ***E04B 1/76*** | (2006.01) |
| ***E06B 11/00*** | (2006.01) |
| ***E04H 1/12*** | (2006.01) |
| ***E04B 1/343*** | (2006.01) |
| ***E04B 1/62*** | (2006.01) |
| ***E04B 1/78*** | (2006.01) |
| ***E04D 13/16*** | (2006.01) |
| ***E04F 15/18*** | (2006.01) |
| ***E06B 1/00*** | (2006.01) |

(52) U.S. Cl.

CPC ..... *E04B 1/762* (2013.01); *E04B 1/34336* (2013.01); *E04B 1/625* (2013.01); *E04B 1/7662* (2013.01); *E04B 1/78* (2013.01); *E04C 2/525* (2013.01); *E04D 13/1618* (2013.01); *E04F 15/18* (2013.01); *E04H 1/1205* (2013.01); *E06B 1/00* (2013.01); *E06B 11/00* (2013.01)

(58) Field of Classification Search

CPC ..... E04B 1/762; E04B 1/625; E04B 1/34336; E04B 1/78; E04B 1/7662; E06B 1/00; E04D 13/1618; E04F 15/18

USPC ..... 52/220.1, 404.1, 407.3, 404.3, 408

See application file for complete search history.

(56) References Cited

U.S. PATENT DOCUMENTS

| | | | | | |
|---|---|---|---|---|---|
| 4,195,452 | A * | 4/1980 | Smith | E04D 13/0725 | 248/48.1 |
| 4,882,888 | A * | 11/1989 | Moore | B32B 13/14 | 428/198 |
| 5,561,959 | A * | 10/1996 | Alderman | E04D 15/06 | 52/404.1 |
| 5,918,436 | A * | 7/1999 | Alderman | E04B 1/7654 | 52/404.1 |
| 5,953,883 | A * | 9/1999 | Ojala | E04B 1/26 | 52/220.1 |
| 6,006,481 | A * | 12/1999 | Jacobs | B32B 5/18 | 52/309.9 |
| 6,804,922 | B1 * | 10/2004 | Egan | B32B 5/02 | 52/309.1 |

(Continued)

*Primary Examiner* — Basil Katcheves

(74) *Attorney, Agent, or Firm* — Woodard, Emhardt, Moriarty, McNett & Henry LLP

(57) ABSTRACT

Among other things, there is shown embodiments of an enclosure such as a portable building with features focusing on overall improvement in energy usage. Wall, roof and floor configurations are disclosed that provide significant energy savings. Methods are also disclosed for preparing such features and/or refitting existing portable buildings for such energy savings.

18 Claims, 5 Drawing Sheets

(56) References Cited

U.S. PATENT DOCUMENTS

| | | | | |
|---|---|---|---|---|
| 6,901,712 | B2 * | 6/2005 | Lionel | E04D 12/002 156/71 |
| 8,209,930 | B2 * | 7/2012 | Babbitt | B32B 5/02 52/309.1 |
| 8,627,628 | B2 * | 1/2014 | McClure | E04D 13/1618 52/404.1 |
| 2004/0163345 | A1 * | 8/2004 | Alderman | B32B 5/02 52/404.1 |
| 2011/0185666 | A1 * | 8/2011 | Russell | B32B 7/12 52/408 |
| 2011/0197530 | A1 * | 8/2011 | Bahnmiller | B32B 5/14 52/309.4 |
| 2014/0115991 | A1 * | 5/2014 | Sievers | E04B 2/562 52/309.4 |

* cited by examiner

ENERGY-EFFICIENT MOBILE BUILDINGS

This disclosure concerns improvements toward better energy efficiency in buildings, and in particular embodiments in portable buildings such as those used in outdoor worksites.

BACKGROUND

Efforts to conserve energy have become a primary focus in many industries in recent times. Technological developments in more efficient ways to produce and use electrical power, for example, have been sought after in many areas, including areas as varied as automotive technology and household appliances, as well as in production and transmittal of power. Naturally, such efforts have come to the fore by virtue of heightened consciousness regarding cost and environmental effects of energy usage.

In the particular field of portable building technology, energy conservation has not been a primary focus. For example, considering mobile office space (e.g. trailers located at a construction site), mobile homes, or the like, little or no improvement in energy efficiency has occurred in many decades. While materials used in such structures may have changed from time to time, a study or overhaul of the structure to seek fundamental energy savings has not been undertaken. It is known that mobile office trailers placed at a building, road or other construction site frequently costs the contractor more in electrical usage, primarily but not exclusively for climate control, than for rent of the trailer itself. Such facilities are built for ease of transport and use, with a focus on reducing weight while maintaining a clean and roomy space for the contractor to use. Little or no focus has been given to energy usage.

Thus, there remains a need for a portable building focused on a strategy of conserving energy and reducing costs of operation to the contractor.

SUMMARY

Among other things, there are disclosed embodiments of buildings and parts of buildings that have been found to reduce energy costs by 50 percent or more when used in portable buildings. Such embodiments resolve the unmet need of providing a portable building in which the cost of energy used in its operation is substantially reduced compared to existing buildings.

In particular embodiments, a portable building is disclosed having at least one wall having a frame, a first insulation layer within or attached to the frame, and a second insulation layer separate from the first insulation layer. The second insulation layer is substantially rigid and fixed with respect to the frame exterior to the first insulation layer, so that the second insulation layer and frame substantially prevent air flow through the first insulation layer. Examples include a one-way gas permeable layer fixed with respect to the second insulation layer and exterior of the second insulation layer, and/or a shell covering the one-way gas permeable layer. The shell may contact the one-way gas permeable layer, for example along a series of vertical strips, forming multiple open channels each defined by a portion of the shell and an opposite portion of the one-way gas permeable layer, with each respective channel extending vertically between a pair of adjacent strips and being open at the top and bottom of the shell.

Embodiments of portable buildings as discloses can include a roof having a frame, a first insulation layer within or attached to the roof frame, and a second insulation layer separate from the first insulation layer. The second insulation layer is substantially rigid and fixed with respect to the roof frame exterior to the first insulation layer of the roof, so that the roof's second insulation layer and frame substantially prevent air flow through the roof's first insulation layer. A layer may be fixed exterior to the roof's second insulation layer and have an outward-facing reflective surface. A shell may be fixed exterior to the roof's second insulation layer. Examples can include a flashing piece fixed with respect to the roof, the flashing piece extending down from the roof beyond the uppermost extent of the wall, wherein a gap exists between the flashing piece and the wall. A gutter piece fixed with respect to the roof can be placed so that the flashing piece is between the gutter piece and the roof, and so that the flashing piece extends downward beyond the furthest extent of the gutter piece.

Embodiments of portable buildings can further include a floor having a frame, a first insulation layer within or attached to the floor frame, and a second insulation layer separate from the first insulation layer. The second insulation layer is substantially rigid and fixed with respect to the floor frame exterior to the first insulation layer of the floor, so that the floor's second insulation layer and frame substantially prevent air flow through the floor's first insulation layer. A layer may be fixed exterior to the floor's second insulation layer having an outward-facing reflective surface. One or more ducts for one or both of heating and cooling are placed in particular embodiments within the floor's frame, and having multiple insulation layers. The multiple insulation layers may include a layer having a reflective surface, the reflective surface facing outward from the duct. Examples of the floor's frame include a series of joists extending along the longest dimension of the building, with each adjacent pair of joists separated by a distance, with the one or more ducts being within one or more of the areas between adjacent joists.

Portable building embodiments can include an airlock area fixed to the exterior wall, the airlock area including a door through an exterior wall, at least one interior wall fixed to the exterior wall so that a space interior to the exterior wall is surrounded by the combination of the exterior wall and the at least one interior wall, and a door through the at least one interior wall. The at least one interior wall includes at least one layer of insulation within it.

Methods are also disclosed, including methods for refurbishing an existing portable building that include removing insulation in one or more of walls, roof and floor of the building. After the removing, first insulation layer is applied to one or more of walls, roof and floor of the building, and a second rigid insulation layer is applied to cover the first insulation layer, so that the second rigid insulation layer substantially prevents air flow through the first insulation layer. Exemplary methods can include applying a one-way gas permeable layer to cover the second insulation layer, and applying a shell to cover the one-way gas permeable layer. For instance, the shell can contact the one-way gas permeable layer along a series of vertical strips, forming multiple open channels each defined by a portion of the shell and an opposite portion of the one-way gas permeable layer, with each respective channel extending vertically between a pair of adjacent strips and being open at the top and bottom of the shell.

DESCRIPTION OF THE ILLUSTRATED EMBODIMENTS

Figure 1:
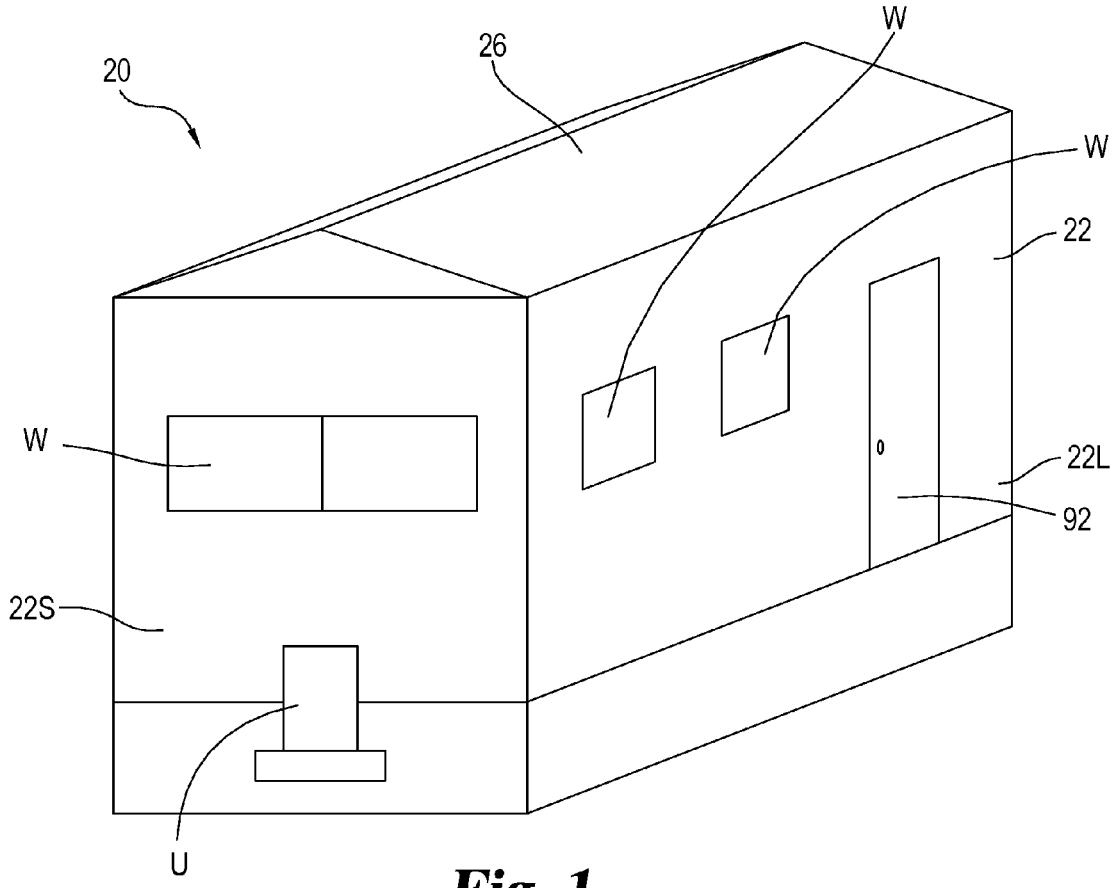
FIG. 1 is a perspective view of an embodiment of a portable building as disclosed herein.

For the purposes of promoting an understanding of the principles of the disclosure, reference will now be made to the embodiments illustrated in the drawings and specific language will be used to describe the same. It will nevertheless be understood that no limitation of the scope of the claims is thereby intended, and alterations and modifications in the illustrated devices and methods, and further applications of the principles of the disclosure as illustrated therein are herein contemplated as would normally occur to one skilled in the art to which the disclosure relates.

Referring generally to the drawings, there is shown an embodiment of a portable office building 20, such as may be used at a construction site for temporary office space during the construction process. It will be understood that such portable buildings may be used for other purposes, such as for housing, and that some or all of the features discussed herein may also be used with semi-permanent or permanent structures. In the illustrated embodiment, building 20 includes one or more side walls 22, floor 24 and roof 26, generally enclosing a usable space (area or volume) 28 that can be subdivided into various rooms or configurations.

The illustrated embodiment of building 20 includes four side walls 22, generally surrounding a rectilinear space 28. It will be understood that at least one side wall 22 (e.g. in the form of a circle or oval) would suffice, and that a smaller or larger number of side walls 22 can be used in other embodiments (e.g. a pentagonal building, with five side walls 22). Each side wall 22, in the illustrated embodiment, includes a frame 32, a first insulation layer 34 on or within frame 32, a rigid insulation layer 36, and a one-way gas permeable layer 38. An external shell 40 may be placed as the exterior-most layer of wall 22. As used herein, "external" generally refers to a location or direction further away or facing away from the area enclosed by side walls 22, and "internal" refers to a location or direction closer or tending toward or facing the area enclosed by side walls 22.

Frame 32 is a skeleton or support form for other parts of wall 22. In particular embodiments, frame 32 includes a series of vertical beams fixed to lower and upper horizontal beams, as is generally done in the construction industry. The individual beams may be made of wood, metal, composites, or other suitable rigid materials. Intermediate horizontal and/or vertical beams may be used to define window spaces. Each adjacent pair of the vertical beams of frame 32 define a space between them.

Insulation layer 34, in a particular embodiment, is a fiberglass insulation which is attached to frame 32 within the spaces between the vertical beams of frame 32. Specific examples include faced fiberglass insulation manufactured by companies like Owens Corning, such as those rated to R-19 or more. It will be understood that other varieties or ratings of fiberglass insulation, or of other insulation materials (e.g. foams, shredded fiber material, etc.), may be used as insulation layer 34, although it is believed that fiberglass insulation may be easiest to use as layer 34 in this context, particularly when refurbishing existing buildings. Further, as the above discussion indicates, layer 34 may be non-continuous in the sense that individual parts of layer 34 may be separated from each other by the beams of frame 32. It will be understood that in other embodiments a continuous or semi-continuous insulation layer may be fixed to frame 32, e.g. on exterior or interior surfaces of frame 32.

The inventor has found that a major factor in heating or cooling loss is air travel through a layer of insulation. Fiberglass insulation, for example, is quite effective as an insulator so long as the air trapped between the fibers remains substantially static. As air moves through the fibers, heat transfer can easily take place. Insulation layer 36 is therefore placed on frame 32 exterior of insulation layer 34. In this embodiment, insulation layer 36 is a rigid, planar layer fixed to the exterior of frame 32 to cover the spaces between individual vertical beams of frame 32, in which insulation layer 34 is located. For example, layer 36 may be fixed to the exterior of the beams (as by nails, other fasteners, adhesives, etc.) so that it is flush against frame 32 or separated from frame 32 by facing from insulation layer 34. In a particular embodiment, layer 36 is formed of one or more panels of rigid plastic or foam (e.g. polystyrene in foam or packed and attached beads), of an exemplary thickness of about ½ inch to one inch. The attachment of layer 36 over layer 34 and frame 32 lessens the air flow potential through layer 34, as layer 36 is attached on frame 32 to eliminate or minimize passages through layer 34 and frame 32. A relatively thick tape (e.g. an adhesive tape or a strip of material fastened or glued), caulk, putty or other seal can be placed over any joints or other cracks between sections or panels of layer 36, to further lessen or eliminate opportunity for air flow out of enclosure 28 and/or through layer 34.

A one-way gas permeable layer 38 is affixed over insulation layer 36 in the illustrated embodiment. Layer 38 in that embodiment is permeable by gases (e.g. air and/or water vapor) in one direction, but is impermeable by such gas(es) in the other direction. Thus, for example, layer 38 has a first side surface 38*a* and an opposite second side surface 38*b*, and while gas(es) may pass through layer 38 in a direction where they enter surface 38*a* and exit surface 38*b*, they cannot pass through in a direction where they first encounter surface 38*b*. Layer 38 is fixed with respect to frame 32 and layers 34 and 36 to the exterior of layer 36. Further, layer 38 is oriented with respect to layer 36 and frame 32 such that air, water vapor and/or other gases can pass through layer 38 from an exterior side to an interior side, but not from an interior side to an exterior side. Layer 38 provides a further barrier to air flow and water vapor passing from the inside of enclosure 28 to the outside, so as to maintain the environment created on the interior of enclosure 28 (i.e. inside of frame 32).

Exterior shell 40 is the outermost layer of wall 22 in this embodiment, fixed with respect to frame 32 exterior of layer 38. Shell 40 may be of any durable material suitable to an outdoor environment. Examples include wood paneling or siding, and stamped or otherwise-formed aluminum such as corrugated aluminum sheets (e.g. FIG. 9). The example of a corrugated aluminum shell 40 fixed to frame 32 outside of layer 38 generally results in vertical portions 40*a* of shell 40 contacting layer 38, and vertical portions 40*b* of shell 40 positioned away from layer 38 between the vertical portions 40*a*. In that embodiment, portions 40*b* create with underlying layer 38 vertical channels C filled with air. As will be explained further below, leaving channels C open at the top and bottom of wall 22 permits air travel between layer 38 and shell 40 to carry away heat from next to layer 38. For example, the substantial summer daytime heating of shell 40, particularly in cases in which shell 40 is a metal, results in substantial warming of the enclosure. With open channels C, warmed air in channels C rises through channels C and out of the open top of the channels, with cooler air from outside of and beneath shell 40 entering the channels. Air flow through channels C can move heated air out of channels C, minimizing heat transfer from a metal shell 40 to the inner layers of wall 22. Such channels C thus operate with a principle similar to a radiator.

Floor 24 in particular embodiments includes a frame 50 of interconnected joists, with spaces between the joists. As will be evident from the following discussion, it has been found for the case of a rectilinear enclosure (e.g. a construction-site trailer) that having joists that are oriented along the long axis of the enclosure provide significant advantages. An insulation layer 52 (essentially the same as layer 34 discussed above) is within the spaces between the joists of frame 50, or otherwise attached to floor 24. A separate insulation layer 54 (essentially the same as layer 36 discussed above) is also attached to frame 50, in this example on the exterior of layer 52 and frame 50. In this embodiment, a reflective sheet 56 is placed exterior of layers 52 and 54. Reflective sheet 56 in a particular example is a product having a first surface or portion having a shiny or reflective layer or coating over a second surface or portion formed of bubble-wrap-like material, e.g. a plastic with interconnected or adjacent air pockets formed in it. Reflective sheet 56 is attached to frame 50 of floor 24 so that the reflective surface faces outward or exteriorly from floor 24. A thin outermost cover 58, made for example of paper, is fastened over reflective sheet 56 and simply acts as a cosmetic covering, akin to a dust cover on the bottom of a piece of furniture.

Ductwork is also provided in floor 24 for heating and/or cooling purposes. As is common in the building industry, ducts 62 for moving warmed or cooled air from an appliance (heater or air conditioner) are supplied, as may be ducts (not shown) for air return or exhaust. In the illustrated embodiment, ducts 62 are shown between joists in frame 50 of floor 24, and interior of reflective sheet 56 and one or both of insulation layers 52 and 54. Having the ducts between the joists, which run the length of the enclosure, allows the ducts to be within insulation layer(s), and to require fewer bends, which can reduce heat or cooling transfer efficiency. In particular embodiments, ducts 62 are themselves insulated with multiple layers. For example, it has been found that wrapping or at least partially enclosing ducts 62 with a layer of reflective sheet material 64 (e.g. the same as reflective sheet material 56 described above) and a layer of one-way gas permeable material 66 (e.g. the same as material 38 described above) provide substantial benefit in minimizing energy loss from ducts.

Roof 26 is constructed similarly to floor 24 in the illustrated embodiment. A frame 70 of separate beams, with spaces between the beams, includes an insulation layer 72 that may be essentially the same as layers 52 and 34 noted above. A separate insulation layer 74 that may be essentially the same as layers 54 and 36 noted above is fixed to frame 70. In particular embodiments, layer 74 is outside or exterior of layer 72 and frame 70, as is indicated above with respect to wall(s) 22 and floor 24, but it will be understood that if desired layer 74 may be interior of frame 70 and/or layer 72. A layer of reflective sheet 76 (e.g. essentially the same as material 56 described above) is placed exterior of frame 22, with a reflective surface 76*a* facing outward or exteriorly. In particular embodiments, roof 26 may have a frame with an upper (exterior) layer and a lower (interior) layer, with the lower layer forming a base for the ceiling of the interior of the enclosure and the upper layer angled with respect to the lower layer to permit easy water drainage. In such an embodiment, insulation layer 74 can be between the upper layer and lower layer, with reflective sheet 76 exterior of the upper layer. An outer shell 78 is atop the reflective sheet 76, with outer shell 78 being a material that is the same as or similar to the material used for shell 40 of wall(s) 22.

Using at least some of the above features, it has been determined that significant energy savings can be achieved. Use of multiple insulation layers, like a rigid insulation layer over a fiberglass insulation layer as exemplified above, not only increases the raw amount of insulation, but also resolves the reason that heating or cooling is lost through fiberglass insulation. A one-way gas permeable layer that prevents air and water vapor from moving into the insulation layer(s) and the enclosure similarly helps preserve the internal environment of the enclosure. An outer shell (e.g. of aluminum) that is unsealed at its top also provides for external heat exchange, so as to have little effect on the internal conditions. Any of these features by themselves has a positive effect on energy usage, and combined they provide even better efficiency.

Other features may be included in such mobile enclosures to improve energy efficiency. For example, previous construction-site trailers have had very few windows, and have had to rely principally on electric lighting. Embodiments of building 20 can include a much larger number and overall area of windows in wall(s) 22, to provide natural light and minimize the necessity for extensive electrical lighting. Referring to FIG. 1 as one example, a mobile building 20 is rectilinear, having a width with two shorter walls 22S and a length with two longer walls 22L, each configured substantially as discussed above with respect to wall 22. Shorter walls 22S include window area W along a substantial portion of their width, e.g. between about 50-70 percent of the width or more, and may include one or more separate windows along that width. Longer walls 22L include a number of windows W in the illustrated embodiment distributed along the length. Particular examples of windows W include double-glazed windows with vinyl frame, for additional resistance to heat exchange around or through them. Building 20 can include additional steps toward maintaining a consistent internal environment, such as caulking windows and/or gaps around wires that pass through walls, floors, beams or other parts of building 20.

Energy-efficient electronics or appliances are also contemplated for buildings 20. In addition to efficient bulbs for lighting, building 20 can include motion sensors configured to turn on lighting when motion (e.g. of a person entering building 20 or a particular room or portion of it) is sensed, and to turn off lighting after a set period of time has elapsed without sensing such motion. One or more automatic electronic thermostats for reducing or eliminating heating and/or cooling during periods of non-use of building 20 are contemplated, as are electric meters or monitors for noting overall usage of power. Buildings 20 may use standard heating and/or cooling units (e.g. U in FIG. 1) rather than window units, and such standard units may be placed beneath windows and connected to ducts 62 in floor 24. The efficiency of the standard heating or cooling unit(s), combined with their connection to multiple-insulated ducts as described above, and the positioning of such unit(s) permitted by the ductwork placement that allows use of windows for natural light, can all work together to improve electrical usage efficiency.

Figure 1A:
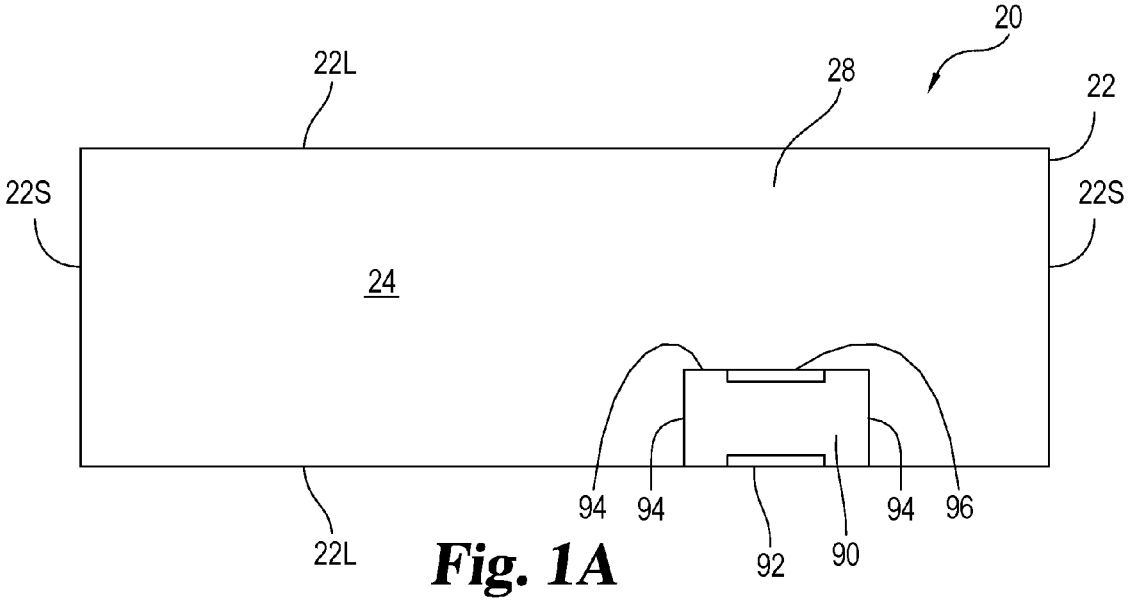
FIG. 1A is a top schematic view of the interior of the embodiment of FIG. 1.
Figure 2:
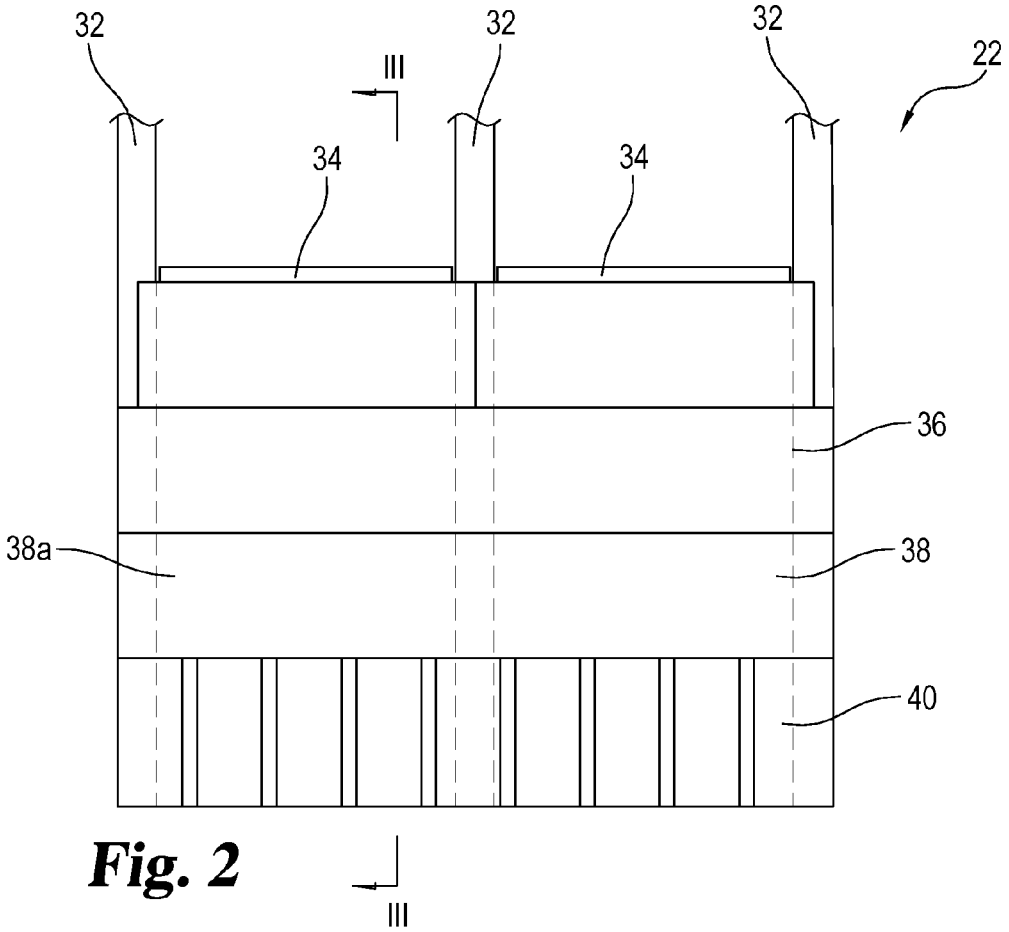
FIG. 2 is a part cut-away view of a portion of an embodiment of a wall as indicated in FIG. 1.
Figure 3:
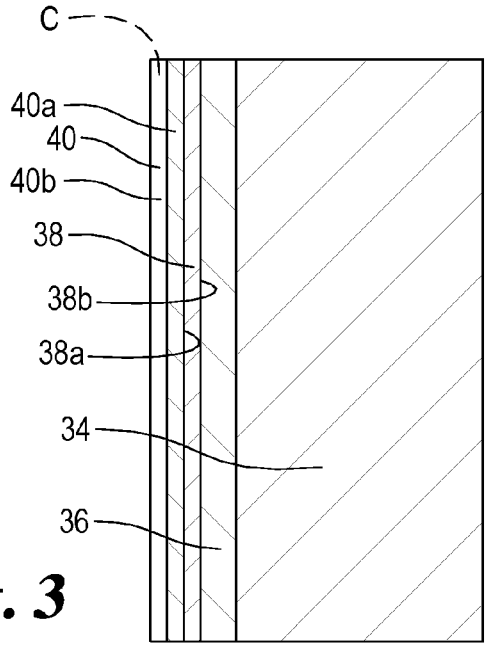
FIG. 3 is a cross-sectional view, taken along the lines III-III in FIG. 2 and viewed in the direction of the arrows, of the embodiment of a wall as indicated in FIG. 2.
Figure 4:
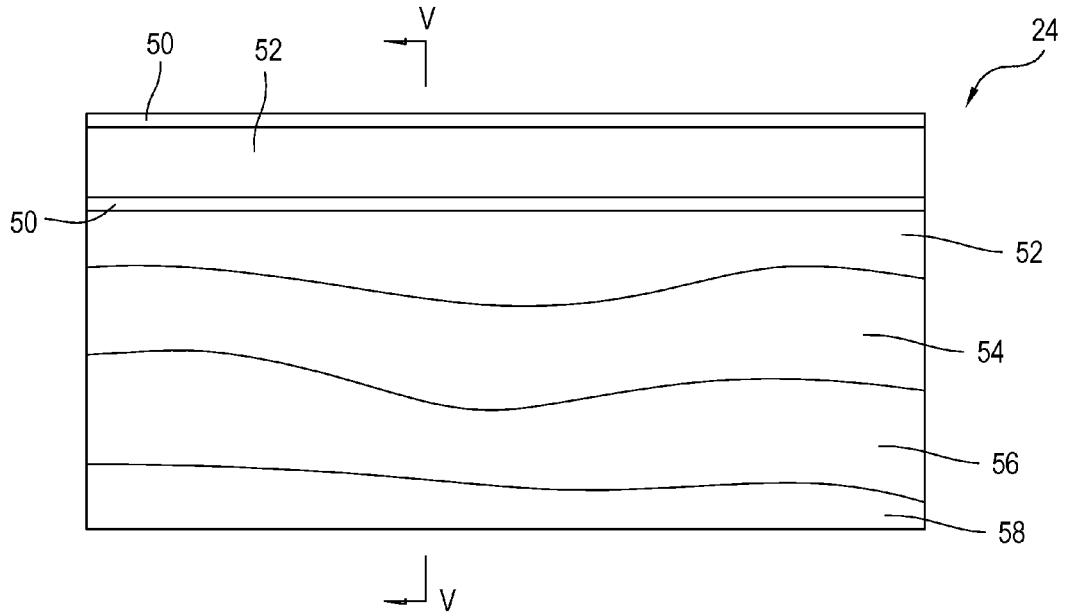
FIG. 4 is a part cut-away view of a portion of an embodiment of a floor as indicated in FIG. 1A.
Figure 5:
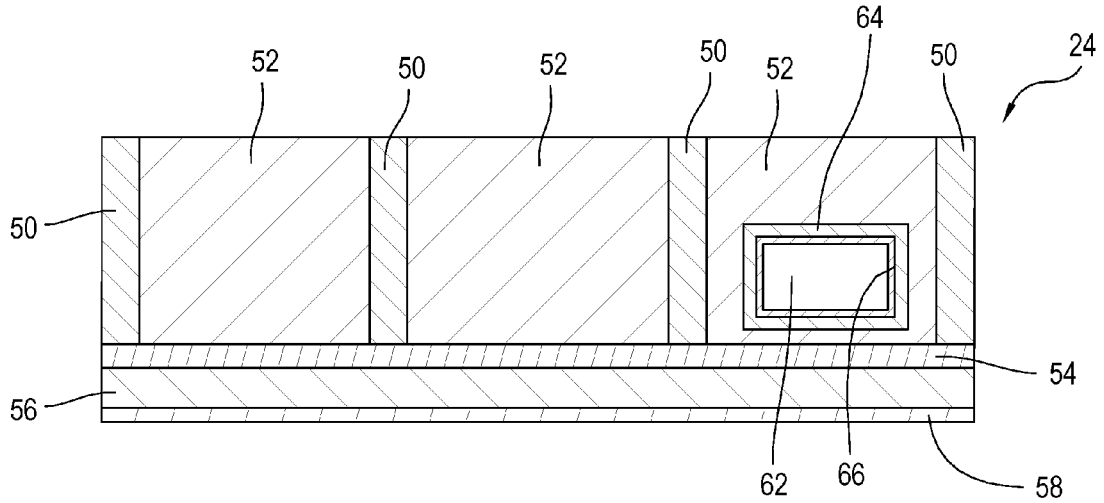
FIG. 5 is a cross-sectional view, taken along the lines V-V in FIG. 4 and viewed in the direction of the arrows, of the embodiment of a floor as indicated in FIG. 4.
Figure 6:
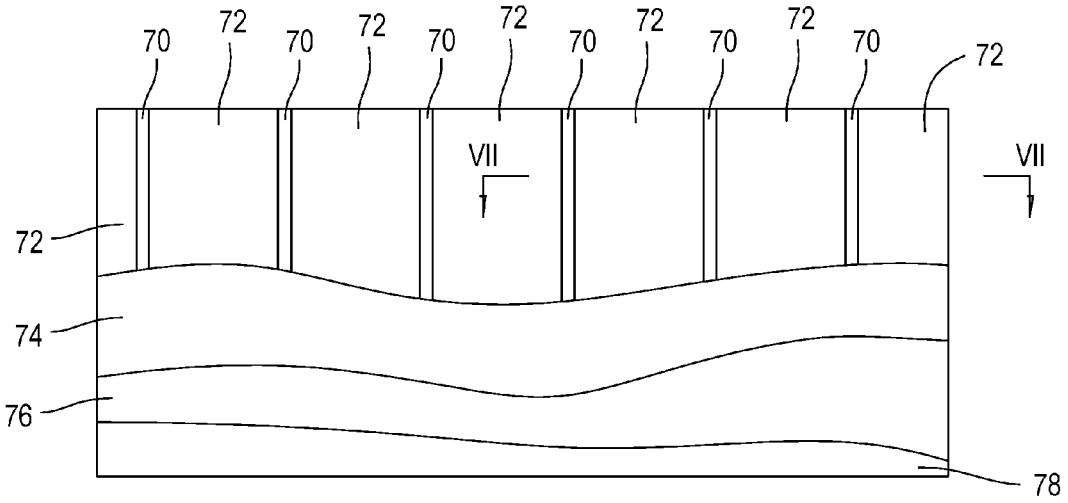
FIG. 6 is a part cut-away view of a portion of an embodiment of a roof as indicated in FIG. 1.
Figure 7:
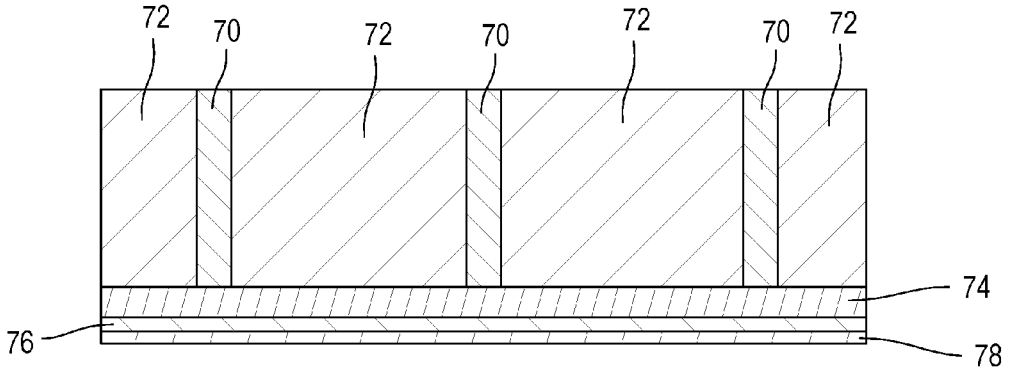
FIG. 7 is a cross-sectional view, taken along the lines VII-VII in FIG. 6 and viewed in the direction of the arrows, of the embodiment of a roof as indicated in FIG. 6.

A particular feature that can be included in building 20 is an airlock portion 90 at an entrance and/or exit of building 20. Referring generally to FIG. 1A, there is shown a door 92 in building 20 that functions as an entrance from and exit to the outside environment. Door 92 leads into airlock portion 90, which is a sub-enclosure within enclosure 28 of building 20, having walls 94 between floor 24 and a ceiling adjoining roof 26, and connecting with external wall 22 through which door 92 is placed. Walls 94 may be insulated, as with one or more of the layers 34, 36, 38 noted above. A door 96 is placed in one of the walls 94 of airlock portion 90, and in the illustrated embodiment door 96 is in a wall 94 opposite door 92, while in other embodiments door 96 may be in another wall 94. Airlock portion 90 provides a small volume that is exposed to the outside environment when door 92 is opened, so that heated or cooled interior environment exposed to that outside environment is limited. While unproductive use of space in mobile buildings (especially mobile office buildings) is generally undesirable, it has been found that energy savings via airlock portion 90 overcomes that undesirability.

Figure 8:
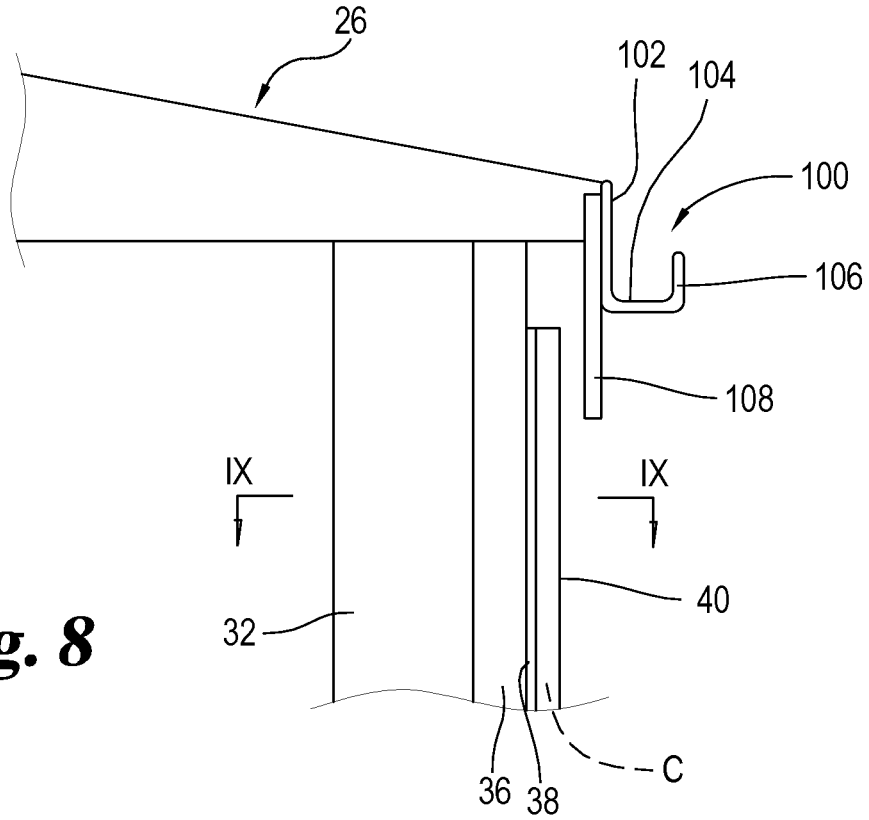
FIG. 8 is a side view of a portion of an embodiment of a wall as indicated in FIG. 1, with additional structure.
Figure 9:
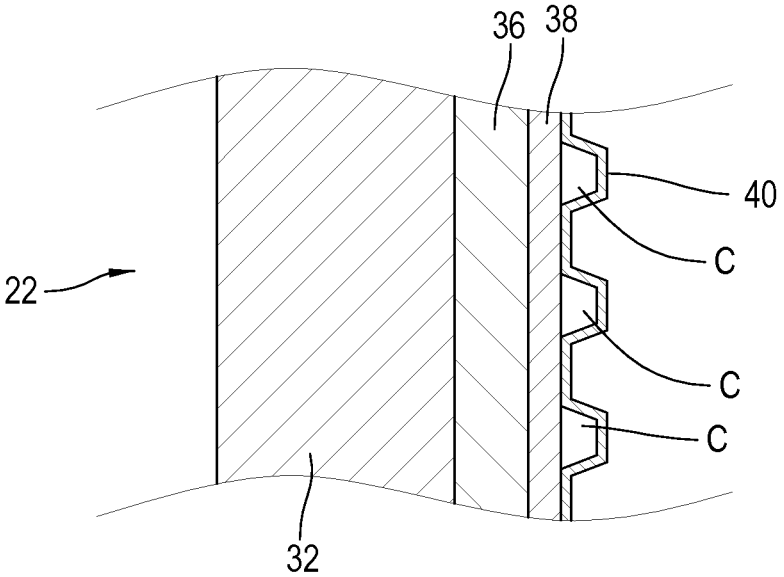
FIG. 9 is a cross-sectional view, taken along the lines IX-IX in FIG. 8 and viewed in the direction of the arrows, of the embodiment of a wall as indicated in FIG. 8.

A particular construction that can be used at the join between roof 26 and a particular wall 22 of building 20 is indicated in FIGS. 8-9. Roof 26 is shown adjoining wall 22. Attached to and extending down from roof 26 over a small portion of wall 22 is a guttering or J-rail 100, which includes a base portion 102 for attaching to roof 26, an extending floor or trough surface 104, and an outer lip 106, giving it a general J-shape in cross section. J-rail 100 is attached to roof 26 so that little or no gap exists between base portion 102 and an upper part of roof 26, so that rain or other moisture that falls on roof 26 run off into J-rail 100. In addition to screws, rivets, adhesives or other ways to fixed base portion 102 to or adjacent to roof 26, caulk or other sealant may be applied to prevent or limit moisture from getting behind base 102 of J-rail 100. As water runs off roof 26 into J-rail 100, it remains in J-rail and/or runs along surface 104 between base 102 and lip 106 to an end, gap, or downspout (not shown).

A flashing or trim piece 108 is fixed with respect to J-rail 100 behind base 102. Flashing 108 hangs down below J-rail 100 and over the outer shell 40 of wall 22. The lower edge 110 of flashing 108 is thus positioned below the upper extremity of shell 40, to prevent water from dripping behind shell 40 from J-rail 100, but flashing 108 is not sealed (or not fully sealed) to shell 40 in this embodiment. In particular examples, a gap exists between flashing 108 and shell 40. As noted above, embodiments of wall 22 can include a series of vertical channels C formed between shell 40 and layer 38, which are open at the top and bottom of wall 22. Water or other debris is naturally unlikely to enter channels C from the bottom of wall 22, particularly where the bottom of wall 22 is multiple feet off the ground, as is common in mobile buildings. Flashing 108 prevents rain or run-off from entering channels C from the top, while maintaining a path for air movement. As the sun shines on building 20, shell 40 heats up, and thus so does the air in channels C, which then rises within channels C. Rising air travels to the top of wall 22, out the open top ends of channels C, and out to the outside environment through the gap between flashing 108 and shell 40. No vacuum prevents such travel, as air from the bottom of wall 22 enters channels C, which air is naturally at least somewhat cooler than the air that had been heated behind shell 40. A flow of air from bottom and out through the top of channels C is thus generated, which assists in moving heat away from layers 38, 36 and 34 of wall 22.

It will be understood that in addition to methods of initial construction of walls, floors, roofs and/or entire buildings as noted above, methods of refurbishing or reconditioning existing mobile or other buildings are contemplated. For example, an existing mobile office building may have its outer shell or skin and any existing insulation removed, leaving a wooden or other frame intact. Particular frame pieces may be replaced, bolstered or repaired as may be needed. Additional window spaces may be provided. Application of a first insulation layer to the frame as indicated above, as by rolling fiberglass insulation into spaces between frame elements, is performed. Application of a second insulation layer exterior of the first insulation layer, as by fixing a rigid insulation layer to the exterior of the frame, is performed. Application of a one-way gas permeable layer and outer shell, as in the examples indicated above, is performed. Steps to provide multiple insulation layers to the floor and roof may also be performed, which can include application of a reflective material as indicated previously. Multiple layers of insulation may be applied to ducts. Existing windows may be replaced with efficient windows, as discussed above, or new efficient windows may be used if additional window space was added. Features such as an airlock portion, automatic switches, and the like may also be added. In this way, not only can the effective life of an existing mobile office be extended, but the efficiency and value of the mobile office can be substantially increased.

Wall, ceiling, and flooring features inside building 20 (i.e. facing enclosure 28) have not been discussed at length herein, and may be chosen for efficiency, aesthetic or other reasons. For example, paneling, wallboard or other internal finishing materials may be placed on frame 32 to create a presentable office area, and desired floor paneling and vinyl or other flooring materials may be used on the internal side of floor 24.

It will be understood that features or structures identified with a particular embodiment may be used by themselves, or with other embodiments as well. For example, a wall construction as noted above may be used in a building without the floor or roof constructions noted, or vice versa. The exemplary parts described herein will provide improvement in energy efficiency, but it is believed that using at least roof, wall and floor embodiments as described herein will provide a much better efficiency improvement than if only one such feature is used. Use of other features, such as additional windows, lighting improvements, and/or configurations of outer shell with open internal channels will further improve efficiency.

While the subject matter herein has been illustrated and described in detail in the exemplary drawings and foregoing description, the same is to be considered as illustrative and not restrictive in character, it being understood that only the preferred embodiment(s) have been shown and described and that all changes and modifications that come within the spirit of the disclosure are desired to be protected. It will be understood that structures, methods or other features described particularly with one embodiment can be similarly used or incorporated in or with respect to other embodiments.

What is claimed is:

1. A portable building, comprising:

at least one wall having a frame, a first insulation layer within or attached to the frame, and a second insulation layer separate from the first insulation layer, the second insulation layer being substantially rigid and fixed with respect to the frame exterior to the first insulation layer, wherein the second insulation layer and frame substantially prevent air flow through the first insulation layer, and an exterior shell having one or more vertical corrugations contacting a separate inner layer so that the inner layer is between the second insulation layer and the shell, wherein each of the vertical corrugations forms with the inner layer a respective vertical channel having openings to the atmosphere at a top and a bottom of the shell, each such vertical channel forming an air travel conduit adapted to allow air to flow through the openings and through such channel adjacent the inner layer, and a flashing overlapping and spaced from the top of the shell, wherein air rising through a respective vertical channel exits the top opening of the respective vertical channel to outside environment through a gap between the flashing and the shell.

2. The portable building of claim 1, wherein the inner layer is a one-way gas permeable layer.

3. The portable building of claim 2, wherein the inner layer is fixed with respect to an exterior of an insulation layer.

4. The portable building of claim 1, further comprising a floor having a frame, a first insulation layer within or attached to the floor frame, and a second insulation layer separate from the first insulation layer, wherein the floor's second insulation layer and frame substantially prevent air flow through the floor's first insulation layer.

5. The portable building of claim 4, further comprising a layer fixed exterior to the floor's second insulation layer and having an outward-facing reflective surface.

6. The portable building of claim 4, further comprising one or more ducts for one or both of heating and cooling, each of the ducts within the floor's frame and having multiple insulation layers.

7. The portable building of claim 6, wherein the multiple insulation layers include a layer having a reflective surface, the reflective surface facing outward from the duct.

8. The portable building of claim 6, wherein the floor's frame includes a series of joists extending along the longest dimension of the building, with each adjacent pair of joists separated by a distance, and wherein the one or more ducts are within one or more of the areas between adjacent joists.

9. The portable building of claim 4, wherein the floor is connected to the wall.

10. The portable building of claim 1, wherein the wall is an external wall.

11. The portable building of claim 10, wherein the wall is a side wall adapted to stand substantially perpendicular to the ground.

12. The portable building of claim 1, wherein the building is at least part of a permanent structure.

13. The portable building of claim 1, wherein the building is at least part of a semi-permanent structure.

14. The portable building of claim 1, wherein the building is at least part of a mobile structure.

15. The portable building of claim 1, further comprising a roof attached to the at least one wall.

16. The portable building of claim 1, further comprising one or more additional walls fixed with respect to the at least one wall to form a rectangular enclosure.

17. The portable building of claim 1, further comprising a gutter piece fixed with respect to the flashing, and wherein the flashing extends downward beyond the furthest extent of the gutter piece.

18. The portable building of claim 1, further comprising a floor attached to the at least one wall.

* * * * *